US006462319B1

(12) United States Patent
Uy et al.

(10) Patent No.: US 6,462,319 B1
(45) Date of Patent: Oct. 8, 2002

(54) MULTI-STAGE SELF-CLEANING CONTROL FOR OVEN

(75) Inventors: Dindo S. Uy, North Hollywood; Cyral Martin Walsh, Sherman Oaks, both of CA (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 09/867,125

(22) Filed: May 29, 2001

(51) Int. Cl.[7] ..... H05B 6/80

(52) U.S. Cl. ..... 219/681; 219/685; 219/400; 219/757; 126/21 A

(58) Field of Search ..... 219/681, 682, 219/683, 684, 685, 400, 401, 757; 126/21 A

(56) References Cited

U.S. PATENT DOCUMENTS 3,884,213 A * 5/1975 Smith ..... 219/681
4,375,184 A * 3/1983 Gilliom ..... 219/400
4,547,642 A 10/1985 Smith
4,601,279 A * 7/1986 Guerin ..... 126/21 A
4,623,781 A * 11/1986 Thomas ..... 219/413
4,661,670 A 4/1987 Eke
5,310,978 A 5/1994 Smith et al.
5,500,508 A 3/1996 Gerl
5,510,601 A 4/1996 Smith et al.
5,539,187 A 7/1996 Smith et al.

* cited by examiner

*Primary Examiner*—Philip H. Leung
(74) *Attorney, Agent, or Firm*—Brooks & Kushman P.C.

(57) ABSTRACT

A method and a cooking appliance has a pyrolytic cleaning control in which multiple stages permit volatile residue to be incinerated before inducing air current flow that can complete the cleaning process throughout the oven housing. The oven combines cooking energy sources, including convection current heating and preferably, jet impingement heating, whose blowers are disabled during a first stage of pyrolytic cleaning to avoid uncontrolled ignitions within the appliance. The second stage of the pyrolytic cleaning process induces current flow to distribute pyrolytically heated air throughout the housing and complete the cleaning process in the apparatus.

14 Claims, 3 Drawing Sheets

MULTI-STAGE SELF-CLEANING CONTROL FOR OVEN

BACKGROUND OF THE INVENTION

1. Field of the Invention

The present invention relates to a method and apparatus for controlling pyrolytic cleaning in a combination microwave and convection heating oven in which blower actuation, such as jet impingement actuation, is deferred to a time or an event near the terminal portion of the cleaning cycle.

2. Background Art

Many cooking ovens have a pyrolytic cleaning function in which the heating elements are operated to obtain a pyrolytic cleaning temperature, for example 800° F. (427° C.) within the oven chamber. Typically, the oven is sealed so that accumulated debris on the walls of the oven can be incinerated and removed as ash residue after the pyrolytic cleaning cycle has terminated. The operation of such cleaning cycles is regulated and test results must comply with standards established, for example Underwriters Laboratory (UL) 858 standard for household electric ranges.

Although recent improvements of cooking devices have employed multiple cooking energy sources such as microwave generators, convection heating sources, and conventional radiant heating elements, the control of pyrolytic cleaning cycles is limited to actuation of radiant heating elements which can be powered to achieve the high temperatures in the oven that are required for pyrolytic cleaning. The operation of additional heating sources during a cleaning cycle is problematic.

One previously known oven construction included a passageway surrounding the oven chamber in which a suction fan operates to cool the outer housing of the cooking appliance. The passageway communicates with the interior oven chamber through a throttled passageway to provide exhaustion of gases emanating from food being processed in the oven chamber. The throttled opening is controlled by a thermally responsive gate so that the throttle passageway is closed during pyrolytic heating of the oven chamber to avoid the release of volatile gases from the oven chamber during cleaning. Accordingly, pyrolytic cleaning is limited to the interior oven chamber.

Another combination microwave and electric self-cleaning oven is disclosed in U.S. Pat. No. 4,547,642. This combination oven includes an air vent from the cooking cavity communicating with an air exhaust passageway including a catalytic oxidation unit that decomposes gases generated when the oven is operating in a self-cleaning mode. A restricted air inlet is configured to limit unaugmented airflow into the oven chamber during the self-cleaning mode. A humidity sensor controls the operation of a blower that augments the flow of air into the cavity when the humidity level caused by microwave only heating is used for cooking.

More recent developments in cooking appliances have combined jet impingement heating sources with microwave cooking sources and radiant heat elements to additionally speed up and control the cooking of foods within the oven chamber. However, while such combined cooking sources accelerate the time of cooking processes, such combinations have not been useful in pyrolytic cleaning operations of those appliances within the test standards of regulations previously discussed.

DESCRIPTION OF THE INVENTION

The present invention overcomes the above mentioned disadvantages by providing a combination cooking source oven having a control that generates a multiple stage pyrolytic cleaning operation. The present invention provides a method and apparatus for pyrolytically cleaning an oven chamber by sealing the chamber, raising the temperature to a pyrolytic cleaning level for a first operating period in which the blower operation is disabled, maintaining the temperature of the pyrolytic cleaning level and actuating the blower operation in a second time period following the first operating period.

In the preferred embodiment, a blower of a jet impingement cooking source is disabled while up to four heating elements are operated to obtain a pyrolytic cleaning temperature within a sealed oven chamber. An additional stage is initiated by the oven control to generate jet impingement currents throughout the oven chamber and the passageways in communication with the chamber that may have been soiled during cooking operations. Preferably, the pyrolytic cleaning temperature is maintained in the second stage while the risk of volatile gases and their inadvertent ignition is avoided by consumption of the gases in the initial cleaning stage. The duration of each stage may be fixed or variable as desired. The preferred embodiment of the method is preferably open loop, and relies only on a fixed time duration for each stage to simplify the control. However, the invention includes closed loop systems, wherein the initiation of the second stage is triggered by an event, such as a sensor detection that enables the control to determine when a level of volatile gases or oxygen level has been sufficiently reduced, so as to avoid excessive operation of the heaters in the cleaning stage.

As a result, the present invention provides a combination cooking source oven with a self-cleaning operation that complies with regulatory guidelines for pyrolytic cleaning operation. Unlike previous controls that operate in response to cooking conditions occurring within the oven, the present invention provides a pyrolytic cleaning operation that effectively cleans additional surfaces in communication with the oven chamber that may be subjected to the accumulation of debris during cooking.

BRIEF DESCRIPTION OF THE DRAWINGS

The present invention will be more clearly understood by reference to the following detailed description when read in conjunction with the accompanying drawing in which like reference characters refer to like parts throughout the views and in which.

DETAILED DESCRIPTION OF A PREFERRED EMBODIMENT

Figure 1:
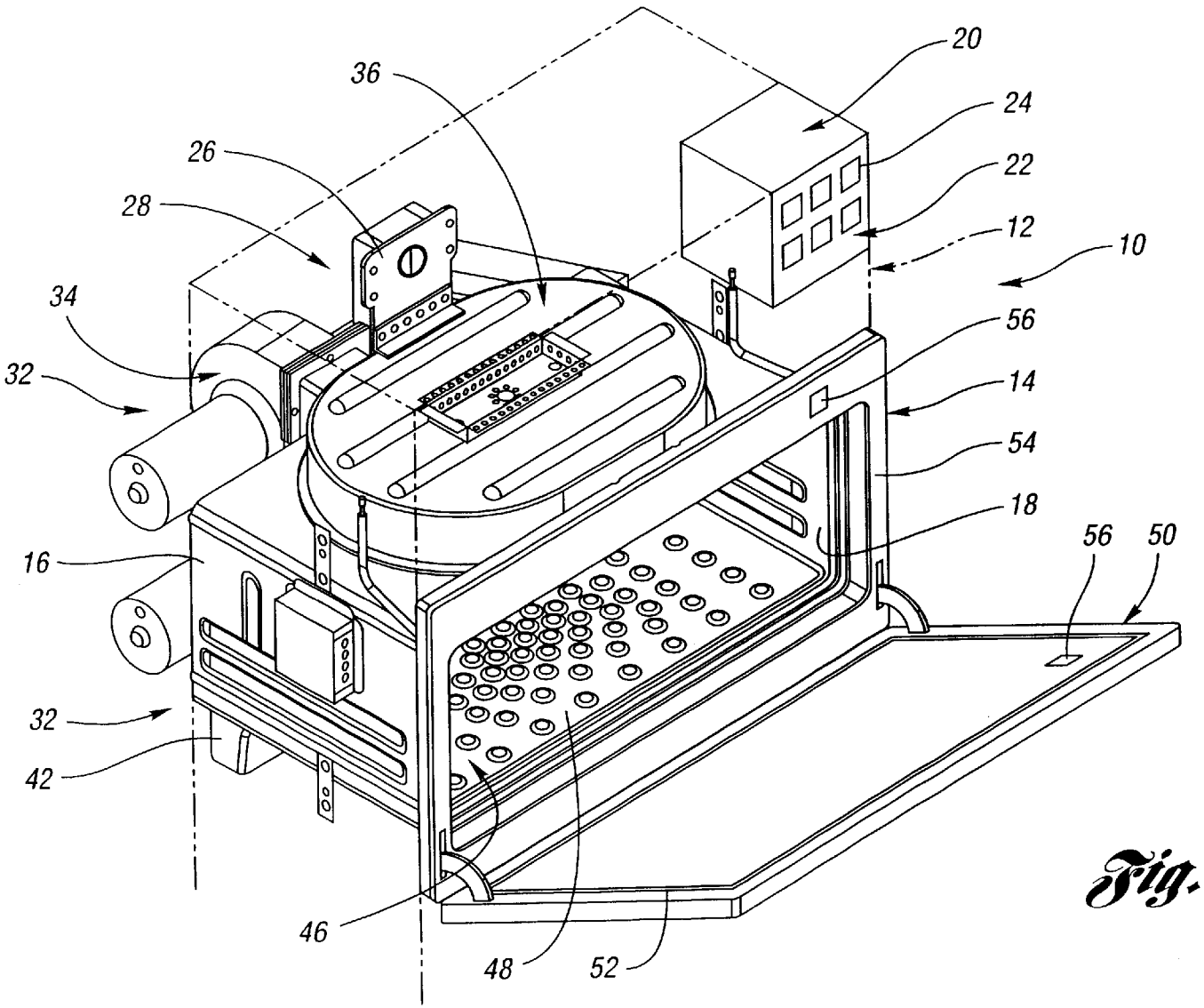
FIG. 1 is a perspective view of a cooking appliance constructed in accordance with the present invention.

Referring first to FIG. 1, a cooking appliance 10 comprises a housing 12 supporting an oven 14. The oven 14 comprises a housing 16 carrying a plurality of cooking sources for generating heat in cooking conditions within the oven chamber 18. The housing 12 carries a control 20, preferably a microprocessor based control, for operating the multiple cooking sources, and preferably including a control panel 22, for example a keypad 24 or other arrangement of knobs and switches, that can be manipulated by a user in order to control operation of the cooking sources.

Figure 2:
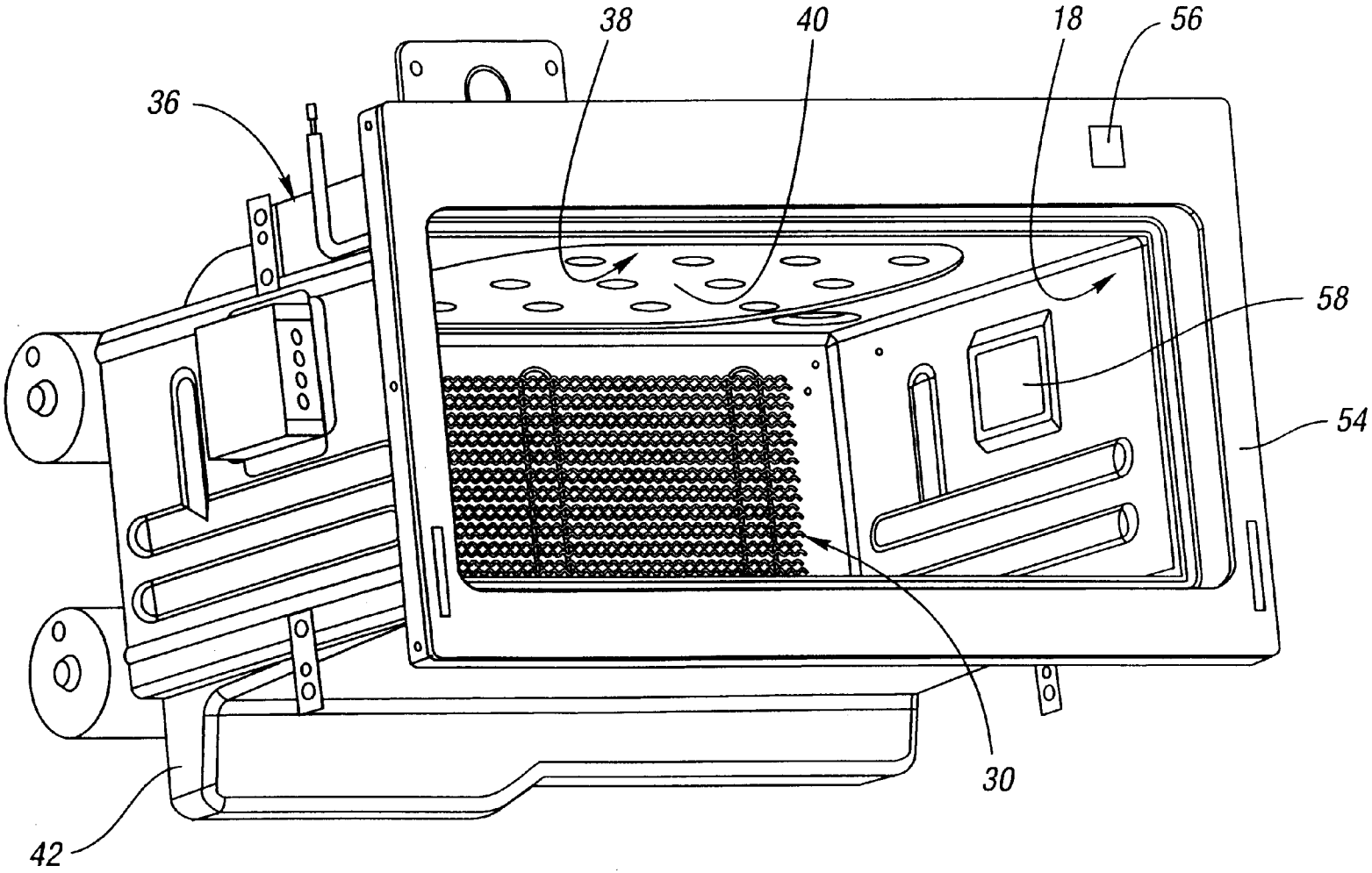
FIG. 2 is a perspective view of a portion the device shown in FIG. 1 taken from a different direction.
Figure 3:
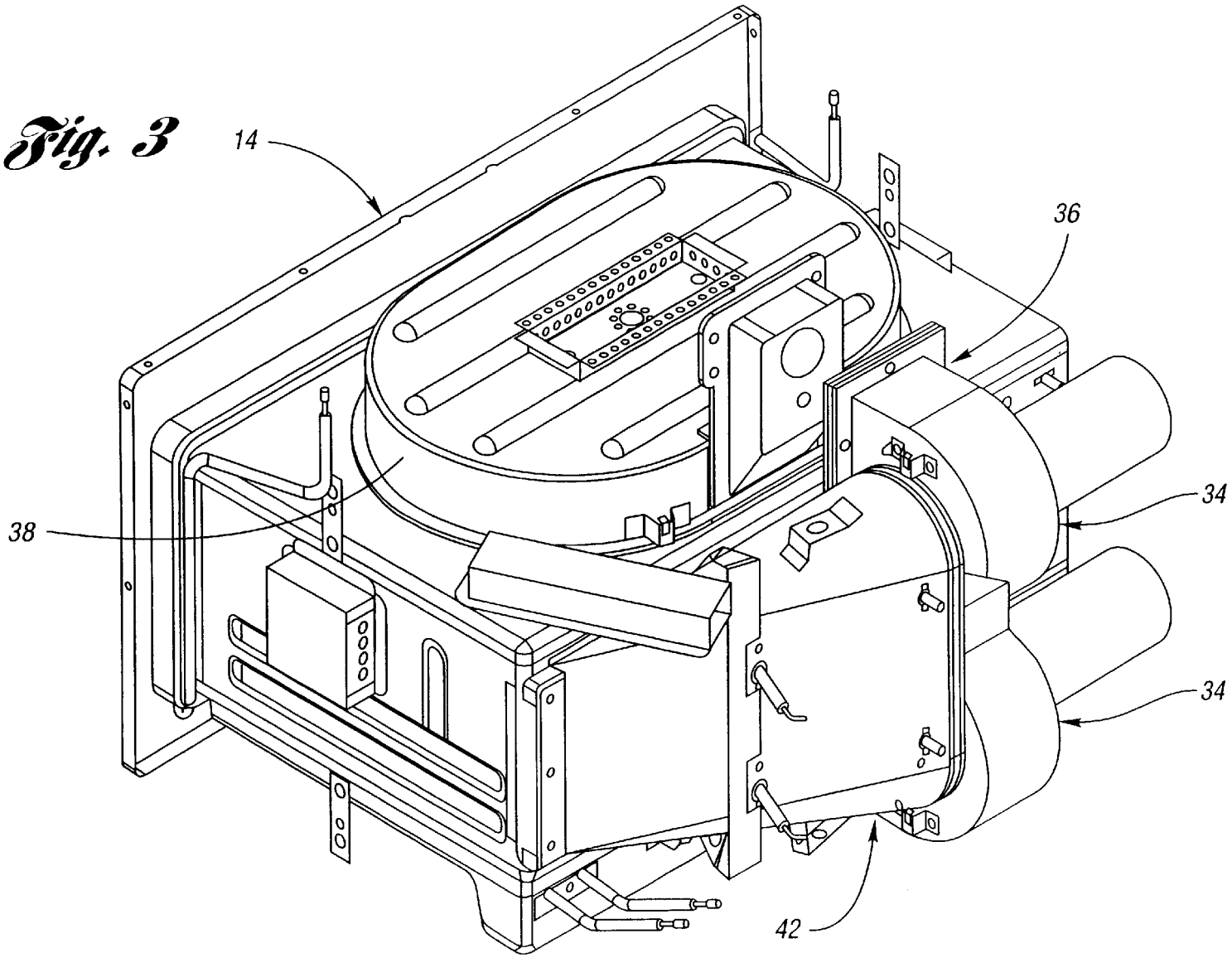
FIG. 3 is a rear perspective view of the portion shown in FIG. 2.

In the preferred embodiment, the cooking sources include a microwave generator that is coupled to waveguide 26, a jet impingement heater 28, that generates and distributes strong convection currents of heated air, and a radiant heating element 30 (FIG. 2) mounted for heating the oven chamber 18, for example by exposure or as in the preferred embodiment, radiant heating from the chamber walls covering the bottom element and mullion element. The control 20 provides for selective actuation of one or more sources by a user as desired, including combinations of sources in a single cooking process.

The jet impingement heater 28 includes ducting 32 that carries at least one blower 34 to induce currents of air within the cooking chamber 18. In the preferred embodiment, an upper duct assembly 36 carries a blower 34 so that its output is delivered to an upper manifold 38 (FIG. 2) through a channel containing a moving vane. The manifold 38 includes a plurality of outlets or nozzles that communicate with the oven chamber 18. In the preferred embodiment, the outlets are in a form of nozzles, preferably arranged in a pattern carried by a manifold plate 40 that is positioned below the moving vane. The vane displacement directs the movement of convection currents throughout the oven chamber. A lower ducting 42 carries a second blower 34 for communication with a lower manifold 46. The lower manifold 46 is enclosed from the ducting 42 to the oven chamber 18. The manifold includes bottom wall 48 of the housing that includes outlets or nozzles communicating currents from the ducting to the oven chamber 18. The outlets are arranged in a pattern that cooperates with the moving nozzles in the vane in the upper manifold 38 to deliver jet impingement currents throughout the cooking area of the oven chamber 18.

While the oven housing 16 defines five walls enclosing the oven chamber 18, an open wall of the chamber is enclosed by a door 50 that is hinged in a well-known manner to enclose the open end of the oven chamber 18. A seal membrane, preferably carried by at least one of the face frame 54 and the door 50, is pliable and compressible between the door 50 and the face frame 54 when the door 50 is in its closed position. Preferably, a latch mechanism 56 mechanically locks the door 50 in a position against the face frame 54 so that the seal 52 is compressed between the surfaces and seals the oven chamber 18 from communication exteriorly of the housing 12. The latch 56 may be operated during cooking modes but is more importantly used for locking the oven door against the face frame when a pyrolytic cleaning operation is to be performed by the appliance 10.

When the pyrolytic cleaning mode has been selected by a user on the control panel 22 the oven cavity temperature is raised to approximately 850° F. (454° C.) for a first period. At this temperature, any soil or food residues on the walls on the inside of the oven chamber 18 are burned off, turning them into ash. The jet blowers are inactive during the first period, defining the first stage of the cleaning operation, since energy is provided to the radiant heater 30 only. Of course, the heating element used in the jet impingement heater may also be actuated, preferably for a period not greater than the first time period, to incinerate any debris that has reached the ducting 36 and 42. The first stage or period of the pyrolytic cleaning operation may be simply fixed as a predetermined time duration that is considered long enough to burn off most of the incineratible residue. After a predetermined time period or event responsive condition has occurred, the jet blowers 34 are turned on by the control to complete the self-cleaning process. In the later stage, the jet blowers insure that all air channels are raised to the clean temperature by moving hot air across all the air passages.

The duration of the self-clean mode may be user selectable and preferably ranges from 2 to 4 hours. The user selects the proper duration depending on how much soil has been detected in the oven. In the preferred production embodiment, a second stage may be set at a 30 minute time duration of a self-clean cycle regardless of the selected duration of the self-clean mode. Nevertheless, the duration of the first stage may also be set to a predetermined amount. Moreover, if a variable cleaning time may be set, the second stage may also be variably selected by the user to occur at a selectable duration during the terminal portion of the cleaning operation. For example, if a pyrolytic cleaning time of 4 hours is selected, the jet blowers 34 could turn on during the last half-hour of the self-clean mode.

In addition to the above described open loop systems, a closed loop system may be employed. For example, a sensor, such as a volatile gas sensor or oxygen sensor, may be placed within the oven to detect the amount of incineratible fuel or vapor remaining in the oven chamber. When the amount of volatile gas has dropped to a predetermined value, the control may be employed to compare the reduced value with a predetermined value so that the comparison will trigger actuation of the jet blowers to complete the pyrolytic cleaning process. Accordingly, the stages may be dynamically changed depending upon the dissipation of volatile gases.

Having thus described the present invention, many modifications will become apparent to those skilled in the art to which it pertains without departing from the scope and spirit of the present invention as defined in the appended claims.

What is claimed is:

1. A method for pyrolytically cleaning an oven combining microwave and convection heating sources for selectively heating an oven chamber with blower operation, the oven having a door, a seal and a latch for maintaining the door in a sealed relation to the oven chamber, the method comprising:

sealing the oven by closing the door, selecting a cleaning mode, raising the temperature in the oven to a pyrolytic cleaning level for a first operating period in which said blower operation is disabled, and maintaining said temperature at a pyrolytic cleaning level and actuating said blower operation at a second time period following said first operating period.

2. The invention as described in claim 1 wherein said actuating blower operation is triggered after a predetermined time period.

3. The invention as described in claim 2 wherein said predetermined time period has a fixed time duration.

4. The invention as described in claim 2 wherein said time period is a terminal portion of a timed cleaning cycle.

5. The invention as described in claim 2 wherein said sensing comprises sensing a combustible gas level.

6. The invention as described in claim 5 wherein said sensing is performed by an oxygen sensor.

7. The invention as described in claim 5 wherein said sensing is performed by a vapor sensor.

8. The invention as described in claim 5 and comparing the level sensed with a predetermined combustible gas level.

9. The invention as described in claim 1 wherein said actuating blower operation is triggered by sensing a predetermined condition.

10. The invention as described in claim 1 wherein said blower is part of a jet impingement heater.

11. A multiple stage cleaning method for a cooking oven having heating elements, a convection current generator, a door seal selectively engaged between an oven body and an oven door, and a control for selectively pyrolytically cleaning said oven, the method comprising:

sensing engagement of said seal between said oven door and said oven body, initiating operation of said heating elements and generating a pyrolytic cleaning condition in said oven for a time period during which said convection current generator is restricted, initiating actuation of said convection current generator in a second time period following said first time period, and maintaining said pyrolytic cleaning condition during at least a portion of said second time period.

12. The invention as described in claim 11 wherein said convection current generator generates a jet impingement stream.

13. The invention as described in claim 12 wherein said jet impingement stream is heated.

14. The invention as described in claim 11 wherein said portion of said second time portion is a terminal portion of said time period.

* * * * *